US011043349B1

(12) United States Patent
Roper

(10) Patent No.: US 11,043,349 B1
(45) Date of Patent: Jun. 22, 2021

(54) ELECTROCHEMICAL SOLID-STATE FIELD-EMISSION ION SOURCE

(71) Applicant: HRL Laboratories, LLC, Malibu, CA (US)

(72) Inventor: Christopher S. Roper, Oak Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 122 days.

(21) Appl. No.: 16/549,210

(22) Filed: Aug. 23, 2019

Related U.S. Application Data

(60) Provisional application No. 62/779,015, filed on Dec. 13, 2018.

(51) Int. Cl.
*H01J 1/304* (2006.01)
*H01J 1/90* (2006.01)

(52) U.S. Cl.
CPC ..... *H01J 1/304* (2013.01); *H01J 1/90* (2013.01)

(58) Field of Classification Search
CPC ..... H01J 1/30; H01J 1/90; H01J 1/304
See application file for complete search history.

(56) References Cited

U.S. PATENT DOCUMENTS 6,036,838 A * 3/2000 Wieser ..... H01M 8/04641 205/339
2005/0109627 A1* 5/2005 Sun ..... H01L 21/76843 205/115
2015/0171455 A1* 6/2015 Mills ..... H01M 8/0656 429/422
2015/0263379 A1* 9/2015 Xiao ..... H01M 10/0445 429/161
2017/0237105 A1* 8/2017 Johnson ..... H01M 8/04029 429/471

* cited by examiner

*Primary Examiner* — Anne M Hines
(74) *Attorney, Agent, or Firm* — O'Connor & Company

(57) ABSTRACT

Some variations provide an electrochemical solid-state field-emission ion source comprising: (a) an ion conductor comprising a protuberance within a protuberance region, wherein the ion conductor contains mobile ions; (b) a first electrode disposed distally from the ion conductor, wherein the protuberance region is on the same side of the first electrode as the ion conductor; (c) a second electrode in contact with the ion conductor, wherein the second electrode is electrically isolated from the first electrode; and (d) an electrical insulator between the ion conductor and the first electrode. Some variations provide a method of electrochemically emitting ions from a field-emission ion source, comprising: applying an electrode potential between the first electrode and the second electrode; oxidizing or reducing the atoms in the atom reservoir, and transporting the atoms into and through the ion conductor as mobile ions; and emitting the mobile ions from the protuberance.

25 Claims, 2 Drawing Sheets

ELECTROCHEMICAL SOLID-STATE FIELD-EMISSION ION SOURCE

PRIORITY DATA

This patent application is a non-provisional application claiming priority to U.S. Provisional Patent App. No. 62/779,015, filed Dec. 13, 2018, which is hereby incorporated by reference herein.

STATEMENT REGARDING FEDERALLY SPONSORED RESEARCH OR DEVELOPMENT

This invention was made with Government support under U.S. Dept. of Defense DARPA Contract No. N66001-15-C-4027. The Government has certain rights in this invention.

FIELD OF THE INVENTION

The present invention generally relates to electrochemical field-emission ion sources.

BACKGROUND OF THE INVENTION

An ion source is a device that creates atomic and/or molecular ions. Ion sources are used to form ions for mass spectrometers, optical emission spectrometers, particle accelerators, ion implanters, and ion engines. Ion-source systems include cold atom systems, compact atom and ion clocks, communication system switches and buffers, single-photon generators and detectors, gas-phase sensors, nonlinear frequency generators, precision spectroscopy instrumentation, accelerometers, and gyroscopes for position, navigation, and timing. However, most of these applications have only been created in laboratory settings.

Existing ion and atom sources require high power or complex, large systems. Ion sources are typically limited in the types of ions they can emit; for example, gallium (Ga) is a typical ion source because its melting point and surface energy make it well-suited to liquid metal ion sources. Existing atom sources rely on thermal evaporation and thus require high temperatures to emit atoms from metals with low equilibrium vapor pressure.

In a liquid metal ion source, a metal (typically gallium) is heated to the liquid state and provided at the end of a capillary or a needle. A cone is formed under the application of a strong electric field. As the cone's tip becomes sharper, the electric field becomes stronger, until ions are produced by field evaporation. These ion sources are particularly used in ion implantation or in focused ion beam instruments.

In U.S. Pat. No. 3,755,704 entitled "Field Emission Cathode Structures and Devices Utilizing Such Structures" to Spindt et al., issued Aug. 28, 1973, vacuum devices incorporate electron-forming sources formed by a cellular array of emission sites in the form of holes in a top-electrode metal layer, where the holes allow electrons to be emitted from bottom-electrode protuberances. However, this patent teaches only field emission of electrons, not field emission of ions (atoms or molecules with a net electric charge due to the loss or gain of one or more electrons).

There is a desire for efficient ion sources from a wide range of metals, beyond gallium, as well as ion sources for semimetals and nonmetals. There is also a desire for lower-temperature atom sources that do not require the high temperatures necessary to melt a metal or a semimetal.

SUMMARY OF THE INVENTION

The present invention addresses the aforementioned needs in the art, as will now be summarized and then further described in detail below.

Some variations provide an electrochemical solid-state field-emission ion source comprising:

(a) an ion conductor comprising a protuberance within a protuberance region, wherein the ion conductor contains mobile ions;

(b) a first electrode disposed distally from, and not in contact with, the ion conductor, wherein the protuberance region is on the same side of the first electrode as the ion conductor;

(c) a second electrode in contact with the ion conductor, wherein the second electrode is electrically isolated from the first electrode; and (d) an electrical insulator between the ion conductor and the first electrode, wherein optionally the electrical insulator forms one or more insulating walls of the protuberance region.

In some embodiments, the first electrode is configured with an aperture, wherein the aperture is an opening into a protuberance region containing the protuberance.

In some embodiments, the first electrode is in the form of an electrode plate proximally disposed, but not touching, the protuberance.

In some embodiments, at least a portion of the first electrode is in the form of an electrode protuberance (e.g., a rod) proximally disposed, but not touching, the protuberance.

In some embodiments, the ion conductor comprises one or more additional protuberances, in the protuberance region or in other regions. Each of these additional protuberances may be located in their own protuberance regions, or there may be one or more protuberance regions containing multiple protuberances.

In some embodiments, the ion conductor comprises at least four total protuberances that form a two-dimensional periodic array (e.g., see FIG. 2).

In some embodiments, the aperture is spatially aligned with the protuberance, that is, the protuberance and the aperture are coaxial.

In some embodiments, the protuberance region has a protuberance-region diameter or length scale selected from about 50 nanometers to about 100 microns, such as from about 1 micron to about 5 microns.

In some embodiments, the aperture has an aperture diameter or size that is less than the protuberance-region diameter or length scale.

In some embodiments, the aperture has an aperture diameter or size selected from about 50 nanometers to about 100 microns, such as from about 1 micron to about 5 microns.

In some embodiments, the protuberance has a maximum diameter or length scale selected from about 10 nanometers to about 50 microns, such as from about 0.1 microns to about 2 microns. In some embodiments, the protuberance has a minimum diameter or length scale less than 1 micron.

In certain embodiments, for example, the protuberance includes a sharp tip. The radius of the sharp tip may be less than 1 micron, less than 100 nanometers, less than 50 nanometers, less than 20 nanometers, or less than 10 nanometers.

In certain embodiments, the protuberance is a sharp blade. The sharp blade may be curved, such as in the shape of a ring.

In some embodiments, the ion conductor further comprises an ion-conducting layer interposed between the second electrode and the electrical insulator, wherein the protuberance protrudes from the ion-conducting layer toward the first electrode.

In preferred embodiments, the ion-conducting layer and the protuberance are of the same composition. In other embodiments, the ion-conducting layer and the protuberance are of different compositions.

Typically, the electrical insulator, or a portion thereof, is interposed between the first electrode and the ion-conducting layer.

In some embodiments, the ion conductor is a solid electrolyte, such as (but not limited to) a solid electrolyte selected from the group consisting of β-alumina, β"-alumina, NASICON, alkali-ion-exchanged NASICON, LISICON, alkali-ion-exchanged LISICON, KSICON, alkali-ion-exchanged KSICON, chalcogenide glasses, and combinations thereof.

The mobile ions may be metal ions, semimetal ions, nonmetal ions, or a combination thereof. In some embodiments, the mobile ions are metal ions, such as those selected from the group consisting of $Na^+$, $K^+$, $Rb^+$, $Cs^+$, $Sr^{2+}$, $Ca^{2+}$, $Yb^{3+}$, $Hg^{2+}$, and combinations thereof.

In some embodiments, the mobile ions are semimetal ions, such as those selected from the group consisting of B, Si, Ge, As, Sb, Te, and combinations thereof.

In some embodiments, the mobile ions are nonmetal ions, such as those selected from the group consisting of C, S, Se, P, F, Cl, Br, I, and combinations thereof. In certain embodiments, the mobile ions are halogen ions, such as F, Cl, Br, I, or At.

The ion conductor may be characterized by an ionic conductivity of the mobile ions of at least $10^{-7}$ S/cm at 25° C., such as at least $10^{-5}$ S/cm at 25° C.

In some embodiments, the ion source further comprises an atom reservoir that is electrochemically configured to controllably supply or receive atoms. The atom reservoir may be in contact with the second electrode, and/or in contact with additional electrode, for example. The atoms from the atom reservoir are typically the same elements as the mobile ions. In some embodiments, the atom reservoir contains an intercalable compound, such as graphite.

In some embodiments, the ion source device is disposed in a vacuum or rarefied gas. In certain embodiments, the ion source is disposed in a vapor-cell system.

Some variations of the invention provide a method of electrochemically emitting ions from a field-emission ion source, the method comprising:

(i) providing a device comprising:

(a) an ion conductor comprising a protuberance within a protuberance region, wherein the ion conductor contains mobile ions;

(b) a first electrode disposed distally from, and not in contact with, the ion conductor, wherein the protuberance region is on the same side of the first electrode as the ion conductor;

(c) a second electrode in contact with the ion conductor, wherein the second electrode is electrically isolated from the first electrode;

(d) an electrical insulator between the ion conductor and the first electrode; and (e) an atom reservoir that is electrochemically configured to controllably supply or receive atoms;

(ii) applying an electrode potential between the first electrode and the second electrode, wherein second-electrode voltage is higher than first-electrode voltage;

(iii) oxidizing or reducing the atoms in the atom reservoir, and transporting the atoms into and through the ion conductor as the mobile ions; and (iv) emitting the mobile ions from the protuberance.

In some methods, the device is disposed in a vacuum or rarefied gas and/or in a vapor-cell system.

In some method embodiments, the electrode potential is at least 500 V or at least 1000 V (1 kV).

DETAILED DESCRIPTION OF EMBODIMENTS OF THE INVENTION

Figure 1:
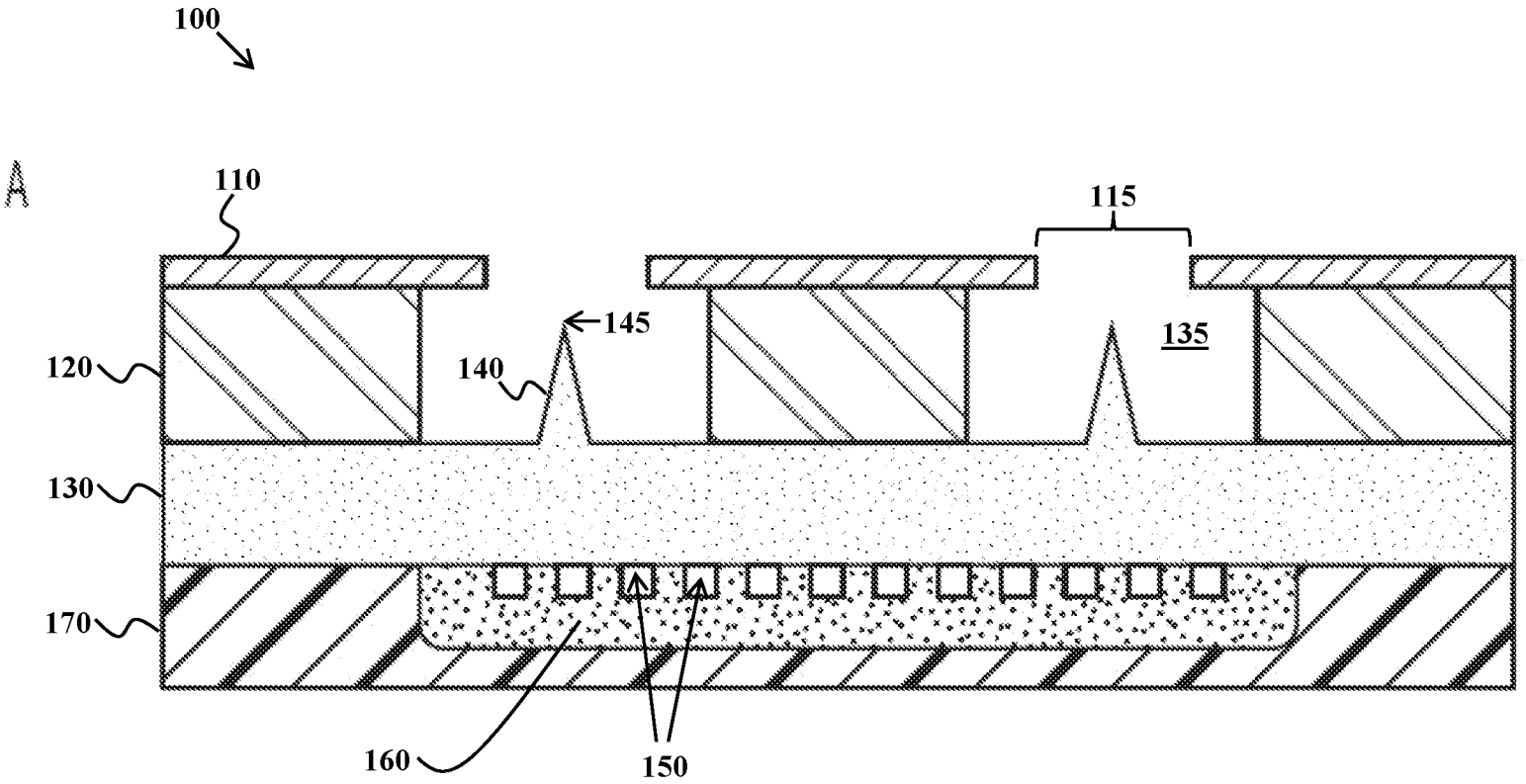
FIG. 1 is an exemplary schematic (side view) of an electrochemical solid-state field-emission ion source, in some embodiments.

The devices, structures, systems, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms, except when used in Markush groups. Thus in some embodiments not otherwise explicitly recited, any instance of "comprising" may be replaced by "consisting of" or, alternatively, by "consisting essentially of."

The present invention in some variations provides an electrochemical solid-state field-emission ion source capable of emitting ions from a protuberance (e.g., a sharp tip) formed from a solid ion conductor. One purpose of this invention is to provide a source of elemental ions, such as (but not limited to) metal ions.

The present invention enables efficient ion sources from a wide range of elements compared to the prior art. Furthermore, the present invention enables lower-temperature atom sources compared to the prior art.

Some variations provide an electrochemical solid-state field-emission ion source comprising:

(a) an ion conductor comprising a protuberance within a protuberance region, wherein the ion conductor contains mobile ions;

(b) a first electrode disposed distally from, and not in contact with, the ion conductor, wherein the protuberance region is on the same side of the first electrode as the ion conductor;

(c) a second electrode in contact with the ion conductor, wherein the second electrode is electrically isolated from the first electrode; and (d) an electrical insulator between the ion conductor and the first electrode.

As intended herein, a "field emission ion source" is a device or structure that is capable of emitting mobile ions into open space, a vapor space, or other fields such as electric fields, magnetic fields, electromagnetic fields, or a combination thereof, in one dimension (e.g., a straight path of ions), two dimensions (e.g., ions emitted onto a plane), or three dimensions (e.g., ions emitted into an arbitrary 3D field).

As intended herein, an "ion-conductor protuberance" or "protuberance" is an amount of ion conductor that has a geometric shape that is distinguished from a base amount of ion conductor. A protuberance may be a cone, a pyramid, a rod, a cylinder, or another geometric shape. A protuberance is capable of emitting mobile ions into open space, a vapor space, or other fields, when a voltage is applied between the first and second electrodes. A "protuberance region" is a region of space in which an observable ion-conductor protuberance is located.

In some embodiments, the ion conductor comprises one or more additional protuberances, in the protuberance region or in other regions. Each of these additional protuberances may be located in their own protuberance regions, or there may be one or more protuberance regions containing multiple protuberances.

If a protuberance has a varying width, the width is preferably smaller at the protuberance end that faces the external environment, away from the second electrode and toward the first electrode. An example is shown in FIG. 1, wherein protuberance 140 has a smaller width along the dimension orthogonal to the ion-conducting layer 130, culminating in a sharp tip.

Figure 2:
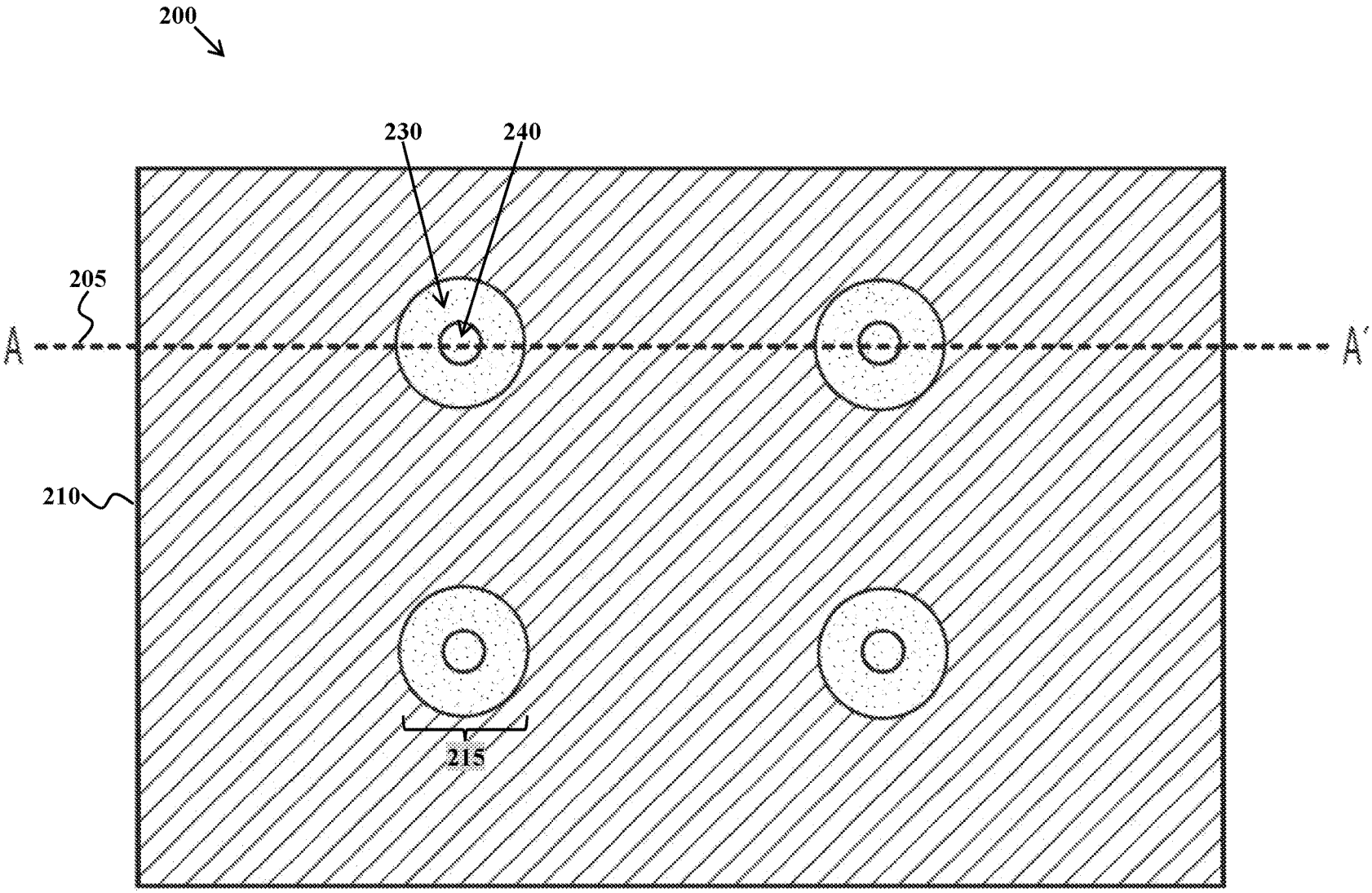
FIG. 2 is an exemplary schematic (plan view) of an electrochemical solid-state field-emission ion source, in some embodiments.

In some embodiments, the ion conductor comprises at least four total protuberances that form a two-dimensional periodic array (e.g., see FIG. 2). The array may be of any pattern, or may be a random arrangement of protuberances.

In some embodiments, the protuberance has a maximum diameter or length scale selected from about 10 nanometers to about 50 microns, such as from about 0.1 microns to about 2 microns. In some embodiments, the protuberance has a minimum diameter or length scale less than 10 microns. In various embodiments, the protuberance has a minimum diameter of about, or less than about, 10 microns, 5 microns, 2 microns, 1 micron, 900 nanometers, 800 nanometers, 700 nanometers, 600 nanometers, 500 nanometers, 400 nanometers, 300 nanometers, 200 nanometers, 100 nanometers, 50 nanometers, 40 nanometers, 30 nanometers, 20 nanometers, 10 nanometers, or 5 nanometers. Certain devices (e.g. large single emitters) employ much larger protuberances, such as on the order of several centimeters.

In certain embodiments, for example, the protuberance includes a sharp tip or an array of sharp tips that may be connected to a common ion conductor. A sharp tip is a zero-dimensional protuberance, if the tip is considered to be an ideal point in space. Another way to characterize a sharp tip is by its radius of curvature, or tip radius, which is the radius of a circle that best fits the actual curvature at the tip. The tip radius of a sharp tip may be less than 1 micron, less than 100 nanometers, less than 50 nanometers, less than 20 nanometers, or less than 10 nanometers. In various embodiments, a sharp tip has a tip radius of about, or less than about, 500 nanometers, 400 nanometers, 300 nanometers, 200 nanometers, 100 nanometers, 75 nanometers, 50 nanometers, 40 nanometers, 30 nanometers, 20 nanometers, 10 nanometers, 5 nanometers, or 2 nanometers.

In certain embodiments, a protuberance is a sharp blade or an array of sharp blades. The sharp blade may be straight or curved, such as in the shape of a ring with a sharp edge. A sharp blade may have a radius of curvature, at the blade tip, less than 1 micron, less than 100 nanometers, less than 50 nanometers, less than 20 nanometers, or less than 10 nanometers. When the blade is in the form of a linear blade, the blade length may be at least about 10 microns, 100 microns, 1 millimeter, 10 millimeters, or more. When a blade is in the form of a ring, the ring diameter or ring circumference may be at least about 10 microns, 100 microns, 1 millimeter, 10 millimeters, or more. Note that the ring diameter is different than the blade radius of curvature, which is measured at the tip of the blade and is smaller than the ring diameter.

In some embodiments, the protuberance region has a protuberance-region diameter or length scale selected from about 50 nanometers to about 100 microns, such as from about 1 micron to about 5 microns. In various embodiments, the protuberance-region diameter or length scale is about 1 micron, 2 microns, 5 microns, 10 microns, 20 microns, or 50 microns. Certain devices (e.g. large single emitters) employ much larger protuberance regions, such as on the order of several centimeters.

The protuberances may be fabricated by known techniques, such as (but not limited to) chemical vapor deposition, physical vapor deposition, microfabrication (e.g., lithography), welding, or 3D printing (additive manufacturing). In an exemplary technique, protuberances are fabricated by starting with a precursor structure with an array of apertures already formed, and directing electrode material into the array of apertures and then masking or subsequently removing material onto the surface surrounding the apertures, whereby individual protuberances (e.g., sharp tips) are formed within each of the protuberance regions.

In typical embodiments, the ion conductor further comprises an ion-conducting layer interposed between the second electrode and the electrical insulator, wherein the protuberance protrudes from the ion-conducting layer toward the first electrode. In some embodiments, the ion-conducting layer functions as a base material to continuously connect all the protuberances, aiding in mechanical integrity as well as helping mobile ions flow uniformly through each of the protuberances. In some embodiments, there is no ion-conducting layer, but rather one or more ion-conductor protuberances disposed directly on a second electrode and/or on a reservoir region.

In preferred embodiments, the ion-conducting layer and the protuberance are of the same composition. In other embodiments, the ion-conducting layer and the protuberance are of different compositions.

The ratio of mass of protuberances to total mass of ion conductor (including the ion-conducting layer(s) and all protuberances) may vary widely, such as from about $10^{-10}$ to about $10^{-1}$, or from about $10^{-9}$ to about $10^{-5}$, for example. As an example, when the ratio is $10^{-2}$, the mass of protuberances is 1% of the total mass of the ion-conducting layer plus all protuberances.

In some embodiments, the mobile ions are metal ions, which may be selected from the group consisting of $Na^+$, $K^+$, $Rb^+$, $Cs^+$, $Sr^{2+}$, $Ca^{2+}$, $Yb^{3+}$, $Hg^{2+}$, and combinations thereof, for example. The metal ions may be an alkali metal ion or an alkaline earth metal ion. Alkali metals include Li, Na, K, Cs, Rb, or Fr. Alkaline earth metal include Be, Mg, Ca, Sr, Ba, and Ra. The metal ions may be ions of any other metal. Metal ions are typically cations, although in certain embodiments, metal anions (e.g., alkalides) are utilized. In some embodiments, the metal ions are an ionized form of an atom of interest in an application (i.e., system, device, or method) which utilizes or is capable of utilizing an atomic metal vapor.

In some embodiments, the mobile ions are semimetal ions. Semimetals may include, but are not limited to, B, Si, Ge, As, Sb, Te, or a combination thereof. Semimetal ions may be either cations or anions, although cations are typical. For example, silicon ions may be $Si^{4+}$, $Si^{2+}$, $Si^{4-}$, or a combination thereof.

In some embodiments, the mobile ions are nonmetal ions. Nonmetals may include, but are not limited to, C, S, Se, P, F, Cl, Br, I, or a combination thereof. Nonmetal ions are typically anions (e.g., $Cl^-$ or $S^{2-}$), but nonmetal ions may be cations in certain embodiments (e.g., $P_9^+$).

In some preferred embodiments, the ion conductor is a solid electrolyte, such as (but not limited to) a solid electrolyte selected from the group consisting of β-alumina, β"-alumina, NASICON, ion-exchanged NASICON, LISICON, ion-exchanged LISICON, KSICON, ion-exchanged KSICON, chalcogenide glasses (e.g., such as RbI—$GeSe_2$—$Ga_2Ge_3$ and/or CsI—$GeSe_2$—$Ga_2Ge_3$), yttria-stabilized zirconia, and combinations thereof. In certain preferred embodiments, the ion conductor contains at least 50 wt % of β-alumina, β"-alumina, or a combination of β-alumina and β"-alumina.

β-alumina and β"-alumina are good conductors of their mobile ions yet allow negligible non-ionic (i.e., electronic) conductivity. β"-alumina is a hard polycrystalline or monocrystalline ceramic which, when prepared as an electrolyte, is complexed with a mobile ion, such as $Rb^+$, $Cs^+$, $Ca^{2+}$, $Na^+$, $K^+$, $Sr^{2+}$, and $Yb^{3+}$, e.g. an ionic version of an alkali or alkaline earth metal. β-alumina and/or β"-alumina are also referred to herein as "beta-alumina." Beta-alumina solid electrolyte is a fast ion-conductor material used as a membrane in several types of electrochemical cells.

In some embodiments, the ion conductor is a solid electrolyte selected from the group consisting of Na-β"-alumina, K-β"-alumina, Rb-β"-alumina, Cs-β"-alumina, Sr-β"-alumina, Ca-β"-alumina, Yb-β"-alumina, Hg-β"-alumina, or combinations thereof. For example, when the mobile ions are $Na^+$, the ion conductor preferably contains Na-β"-alumina (sodium beta-alumina). Sodium beta-alumina is a non-stoichiometric sodium aluminate known for its rapid transport of $Na^+$ ions.

The ion conductor may include compounds containing a semimetal or nonmetal that forms the intended mobile ion. For example, in the case of chlorine as the mobile ion ($Cl^-$), ion conductors with predominant chloride conductivity may be employed, such as $PbCl_2$, $SnCl_2$, $KPb_2Cl_5$, $K_2PbCl_4$, $PbCl_2$—$Al_2O_3$, $CsSnCl_3$, or a combination thereof. Other halogens (e.g., F, Br, or I) may replace Cl in these or similar compounds as the ion conductor, when it is desired to emit ions of such other halogens.

The ion conductor may be characterized by an ionic conductivity of the mobile ions of at least $10^{-9}$ S/cm at 25° C., such as at least $10^{-7}$ S/cm at 25° C., or at least $10^{-5}$ S/cm at 25° C. In various embodiments, the ion conductor has an ionic conductivity of the mobile ions of about, or at least about, $10^{-5}$ S/cm, $10^{-4}$ S/cm, $10^{-3}$ S/cm, or $10^{-2}$ S/cm, measured at 25° C. or measured at a device operating temperature, such as 50° C., 100° C., or 200° C., for example. When the ion conductor includes a first material for an ion-conducting layer and a second material for the protuberances, both of the first and second materials preferably have an ionic conductivity of the mobile ions of at least $10^{-9}$ S/cm at 25° C., such as at least $10^{-7}$ S/cm or at least $10^{-5}$ S/cm at 25° C.

The ionic conductivity of the protuberances enables them to be capable of field-emitting the mobile ions at relatively low temperatures, such as an operating temperature of about, or less than about, 500° C., 400° C., 300° C., 200° C., 100° C., 50° C., or 0° C. These low operating temperatures are possible because, in this disclosure, the mechanism of field emission of ions is not thermal evaporation of materials such as metals, but rather electric field-induced ion emission toward the first electrode, out of electrode apertures, and into a field. Electrochemistry replenishes the ions inside the ion conductor. The disclosed device is therefore an electrochemical solid-state field-emission ion source, not a thermal ion source or a combined, liquid-state thermal/electrochemical ion source.

At least one first electrode is included in the ion source. The first electrode permits the conduction of electrons. The first electrode is at least a fair electrical conductor. In some embodiments, the electrical resistivity of the first electrode is preferably less than 10 kΩ·cm, more preferably less than 1 kΩ·cm, and most preferably less than 1 Ω·cm, measured at 25° C. In some preferred embodiments, the electrical resistivity of the first electrode is less than less than $10^{-4}$ Ω·cm, measured at 25° C.

The first electrode may be a uniform layer or a non-uniform layer. The thickness of the first electrode is preferably less than 500 μm and more preferably less than 100 μm. In various embodiments, the thickness of the first electrode is about 5 nm, 10 nm, 100 nm, 1 μm, 10 μm, 100 μm, 500 μm, or more.

The first electrode preferably (but not necessarily) does not chemically interact with the ionic species emitted from the protuberances. For example, the first electrode preferably does not form an intermetallic phase with the ionic species emitted.

Exemplary first electrode materials include Pt, Mo, and W, for example. The first electrode may also entail more than one layer, such as a Ti adhesion layer and a Pt layer.

In some embodiments, the first electrode is configured with an aperture, wherein the aperture is an opening into a protuberance region containing the protuberance. An aperture is preferably spatially aligned with a protuberance, as is depicted in FIGS. 1 and 2. When an aperture is spatially aligned with a protuberance, the protuberance and the aperture are coaxial or substantially coaxial. In other embodiments, there are apertures that are not spatially aligned with protuberances. For example, apertures may be non-coaxial, such as at an angle, relative to the protuberance axis. In some embodiments, an aperture axis may be offset compared to the protuberance axis, even though the axes may still be parallel.

In some embodiments, the aperture has an aperture diameter or size that is less than the protuberance-region diameter or length scale, such as is shown in FIG. 1. In some embodiments, the aperture has an aperture diameter or size selected from about 50 nanometers to about 100 microns, such as from about 1 micron to about 5 microns. In various embodiments, the aperture diameter or size is about, or less than about, 10 microns, 5 microns, 2 microns, 1 micron, 900 nanometers, 800 nanometers, 700 nanometers, 600 nanometers, 500 nanometers, 400 nanometers, 300 nanometers, 200 nanometers, 100 nanometers, 50 nanometers, 40 nanometers, 30 nanometers, 20 nanometers, or 10 nanometers.

The aperture diameter or size is typically greater than the protuberance diameter or length scale. In some embodiments, the aperture diameter or size is less than the maximum protuberance diameter or length scale, or less than the average protuberance diameter or length scale.

In some embodiments, the first electrode is patterned with many openings that correspond to many protuberances. For example, if there is an array of ion conductor tips, it is preferred that each tip is positioned near an opening in the first electrode. In some embodiments, each tip (or other protuberance) is aligned to its own aperture in the first electrode. The number of apertures typically scales with the number of protuberances, since preferably there is one aperture for each protuberance.

In some embodiments, the first electrode is in the form of an electrode plate proximally disposed with, but not touching, the protuberance. For example, if the objective is to impact an electrode plate with ions, such as in ion-milling or etching applications, the electrode plate need not have an aperture. An aperture may be created during an ion-milling technique.

In some embodiments, at least a portion of the first electrode is itself in the form of an electrode protuberance (e.g., a rod) proximally disposed with, but not touching, the ion-conductor protuberance. For example, an electrode rod may extend near (such as within 1-10 microns), but not touch, the ion-conductor tip or other protuberance. In these embodiments, there may be no aperture in the first electrode.

At least one second electrode is included in the ion source. The second electrode permits the conduction of electrons. The second electrode is at least a fair electrical conductor. In some embodiments, the electrical resistivity of the second electrode is preferably less than 10 kΩ·cm, more preferably less thanl kΩ·cm, and most preferably less than 1 Ω·cm, measured at 25° C. In some preferred embodiments, the electrical resistivity of the second electrode is less than less than $10^{-4}$ Ω·cm, measured at 25° C.

The second electrode must not be in direct electrical contact with the first electrode, i.e., the second electrode is electrically isolated from the first electrode. By "electrically isolated" it is meant that the second electrode is not in direct electrical contact with the first electrode, but electrical communication is possible through an external circuit. Electrons cannot flow directly from the first electrode to the second electrode, but charge can flow, in the form of electrons while in one electrode, then ions while in the ion-conducting layer, and then electrons while in the other electrode.

The second electrode is in direct or indirect contact with the ion-conducting layer (or with the ion-conductor protuberances, if there is no ion-conducting layer). Optionally, the second electrode is in contact with a reservoir region containing metal atoms or ions.

The second electrode may be fabricated from common electrode materials including, but not limited to, Pt, Mo, W, Ni, Cu, Fe, and Al. The second electrode may be solid or porous. In some embodiments, the second electrode is a transparent electrode, fabricated from, for example, metal oxides (e.g., indium tin oxide, doped tin oxide, and/or doped zinc oxide).

In some embodiments, the second electrode comprises an intercalable material capable of being intercalated by at least one element to be emitted from the protuberances. The intercalable material is preferably graphite, and may alternatively or additionally include $MoS_2$ and/or $TaS_2$. The thickness of the intercalable material is preferably less than 100 microns and more preferably less than 10 microns. The intercalable material may be present in a uniform layer. In some embodiments, the intercalable material is present in the form of particles in a matrix, such as a polymer binder. A polymer binder (when present) preferably has low outgassing and is compatible with ultra-high vacuum. Exemplary polymer binders include polyvinylpyrrolidone, poly (methyl methacrylate), cellulose resins, fluoroelastomers, etc. Additives may be included in the matrix to increase the electrical conductivity of the electrode. Such additives may be small conductive carbon particles (e.g. Super P® carbon black).

In some embodiments, the second electrode includes more than one layer, such as a Ti adhesion layer and a Pt layer, or a Cu layer and a graphite layer, for example.

When it is desired to actually operate the device, an electrical potential (voltage) needs to be applied between the first electrode and second electrode. The applied voltage may be about, or at least about, 100 V, 200 V, 300 V, 400 V, 500 V, 600 V, 700 V, 800 V, 900 V, 1 kV, 1.5 kV, 2 kV, or higher. When the device is not in operation, such as after fabrication or while being shipped, stored, configured for use, cycled between operating states, or otherwise stopped, the applied voltage may be 0 V or close to 0 V.

It is desirable that an electrical potential, when applied, does not vary considerably (e.g. <0.1 V) across the second electrode surface. Thus, the second electrode thickness is preferably selected based on the second-electrode material resistivity and the expected ionic current through the ion conductor.

The second electrode may be a uniform layer or a non-uniform layer. The thickness of the second electrode may be less than 500 μm or less than 100 μm. In various embodiments, the thickness of the second electrode is about 1, 5, 10, 20, 30, 40, 50, 75, 100, 200, or 500 μm.

Each electrode is typically connected to an electrical lead fabricated from an electrically conductive material. A lead is an electrical connection consisting of a length of wire, metal pad, metal trace, or other electrically conductive structure. Leads are used to transfer power and may also provide physical support and potentially provide a heat sink. In some embodiments, a device is provided without such leads, which may be added at a later time, before use.

The second electrode may be a metal grid (e.g., platinum mesh) with spacing less than 10 microns or less than 1 micron, for example. The spacing here refers to the length between adjacent electrode lines or regions in one direction. The length in the orthogonal direction may be much larger. As an example, in certain embodiments, an electrode metal grid has a unit cell grid with 1 micron spacing between metal in one direction and 100 microns between metal in the other direction, forming rectangular grid openings.

In some embodiments, the second electrode is not in direct contact with the ion conductor but is in ionic communication with the ion conductor, through an intermediate layer. By "ionic communication" between the ion conductor and the second electrode, it is meant that ions, or their neutral forms, are capable of being transported between the ion conductor and the second electrode. Note that in some embodiments, ions (i.e. positively or negatively charged atoms) may be neutralized at the interface between the ion conductor and the second electrode, so that ions (e.g., as $Rb^+$ or $Na^+$) do not leave the ion conductor. In these embodiments, neutralized forms of the ions (e.g., Rb or Na) are transported away from the ion conductor.

Typically, the electrical insulator, or at least a portion thereof, is interposed between the first electrode and the ion-conducting layer. An example is shown in FIG. 1, wherein electrical insulator 120 separates the first electrode 110 from the ion-conducting layer 130. In some embodiments, the electrical resistivity of the electrical insulator is preferably greater than 10 kΩ·cm, more preferably greater than $10^3$ kΩ·cm, even more preferably greater than $10^6$ kΩ·cm, and most preferably greater than $10^9$ kΩ·cm, measured at 25° C.

The electrical insulator does not necessarily form one or more insulating walls of the protuberance region. In some embodiments, for example, there is a single protuberance (e.g., tip) and first electrode that is in the form of a wire. A bushing around the wire forms an electrical insulator that is between the first electrode and the ion conductor.

Exemplary materials for the electrical insulator include, but are not limited to, glass, quartz, alumina, silica, porcelain, paper, or polymers (e.g., polyethylene terephthalate, polytetrafluoroethylene, or wax). Insulator materials may also be employed to isolate and electrically insulate the electrodes from other parts of the system.

In some embodiments, the ion source further comprises an atom reservoir that is electrochemically configured to controllably supply or receive atoms. The atom reservoir may contain atoms in the solid, liquid, and/or vapor phase. The atom reservoir may be in contact with the second electrode, and/or in contact with an additional electrode, for example. The atoms from the atom reservoir are typically the same elements as the mobile ions in the ion conductor. Alternatively, a different atomic species may be contained within the atom reservoir.

In some embodiments, the atom reservoir contains an intercalable compound, such as a carbonaceous material selected from the group consisting of graphite, graphene, holey graphene, graphene platelets, carbon nanotubes, fullerenes, activated carbon, coke, pitch coke, petroleum coke, carbon black, amorphous carbon, glassy carbon, pyrolyzed carbon-containing molecules, pyrolyzed parylene, polyaromatic hydrocarbons, and combinations thereof. The intercalable compound is capable of intercalating one or more atoms to contain them in the atom reservoir.

The atom reservoir typically has walls that are preferably impermeable to the atomic species contained inside the atom reservoir, to avoid unintentional loss of atoms out of the reservoir. The side of a reservoir wall that faces the interior of the reservoir preferably does not chemically interact with the atoms or ions, e.g., does not form an intermetallic phase and does not chemically react with the atoms or ions. The side of a reservoir wall that touches the ion conductor, if any, preferably does not chemically interact with the ion conductor, other than possible chemical bonding to adhere to the ionic conductor. Preferably, the wall does not form mobile ions that are transported within the ion conductor. Exemplary materials for the atom reservoir walls include Pt, Mo, W, or a combination thereof.

The atom reservoir may be integrated with the second electrode. For example, the atom reservoir may comprise graphite or graphitic carbon. The graphite or graphitic carbon provides electrical conductivity, to function as the second electrode, and also provides a means of storing atoms, as an intercalation compound.

Multiple sets of first electrodes, ion-conducting layers, and second electrodes may generally be present. In some embodiments, two or more first electrodes are employed. In these or other embodiments, two or more second electrodes are employed. In any of these embodiments, or other embodiments, two or more ionic conductors are employed.

One or more of the second electrodes may contain an alternate source of replacement ions for the ion-conducting layer (and for the protuberances). The alternate source of replacement ions may be a metal (e.g. silver), an ion-containing species (e.g. a salt), an intercalated compound (e.g. Rb intercalated into graphite), an intermetallic (e.g. gold and rubidium), or a solid or liquid elemental form of an alkali metal or an alkaline earth metal, for example.

In some embodiments, an intercalation compound (e.g. Rb intercalated into graphite) is a substantial portion of the second electrode. In the case of a solid or liquid alkali metal second electrode, the alkali metal may be capped with a non-reacting layer such as Pt to seal in the alkali metal and prevent corrosion and/or oxidation.

The ion source may also include electrical connections to the first and second electrodes. The electrical connections are preferably connected to metal-containing bond pads for connection to an external circuit. The electrical connections may include one or more connections selected from the group consisting of through-wafer vias, patterned electrically conductive thin films, doped regions of semiconductors, and wire bonds. Patterned thin films may be parallel with the first electrode, in cases where the first electrode is substantially flat. Parts of patterned thin films may be at an angle with the first electrode, in cases where the first electrode is substantially flat. Typically, a portion of the electrical connection to one or more of the electrodes will be out of the plane of the electrode to which it is connected, in cases where the first electrode is substantially flat.

The ion source may be contained within a vapor cell, a cold atom system, an atom chip, an atom gyroscope, an atomic clock, a communication system switch or buffer, a single-photon generator or detector, a gas-phase atom sensor, a nonlinear frequency generator, a precision spectroscopy instrument, an accelerometer, a gyroscope, an atom interferometer, a magneto-optical trap, an atomic-cloud imaging apparatus, or an atom dispenser system, for example. In some embodiments, the ion source is disposed in a vacuum or rarefied gas. In certain embodiments, the ion source is disposed in a vapor-cell system. The vapor-cell system may include a vapor-cell region configured to allow at least one optical path into a vapor phase within the vapor-cell region.

FIG. 1 is an exemplary schematic (side view) of an electrochemical solid-state field-emission ion source 100, in some embodiments. Ion source 100 is configured with a plurality of protuberances 140 contained with protuberance regions 135. Each of the protuberances 140 has a sharp tip 145. The protuberances 140 and protuberance regions 135 are integrally disposed on an ion-conducting layer 130. The ion-conducting layer 130 is disposed partially on a second electrode 150, partially on an atom reservoir 160, and partially on reservoir walls 170. The second electrode 150 is in the form of a pattern (depicted by a sequence of squares). The second electrode 150 is contained within an atom reservoir 160. A substrate 170 is disposed under ion-conducting layer 130 and the interface between atom reservoir 160 and substrate 170 forms reservoir walls. The first electrode 110 is patterned such that there is a plurality of apertures 115 spatially aligned with the protuberances 140. In FIG. 1, without limitation, the aperture size (width of the opening) is greater than the maximum protuberance 140 width and less than the protuberance region 135 width. An electrical insulator 120 separates the first electrode 110 from the ion-conducting layer 130, and also forms walls of the protuberance regions 135.

FIG. 2 is an exemplary schematic (plan view) of an electrochemical solid-state field-emission ion source 200, in some embodiments. Ion source 200 is configured with a first electrode 210 having a pattern of apertures 215 that reveal protuberances 240 and ion-conductor material 230 surrounding each of the apertures 215, in 2D plan view (the ion-conductor material 230 is below the protuberances 240, as shown in FIG. 1). The plan view of FIG. 2 shows the maximum diameter of protuberances 240, which diameter is less than the aperture 215 size. Line A-A' on FIG. 2 corresponds to the 2D slice forming the side view of FIG. 1.

Conventional fabrication techniques may be utilized to make the electrochemical solid-state field-emission ion sources described herein. Chip-scale devices are preferably constructed using microfabrication techniques, including some or all of lithography, evaporation, shadow-masking, evaporation, sputtering, wafer bonding, die bonding, anodic bonding, glass frit bonding, metal-metal bonding, and etching.

The atom reservoir and/or reservoir wall may be disposed on a substrate. Alternatively, or additionally, the second electrode may be disposed on a substrate, such as when the atom reservoir is in contact with an additional electrode but not the second electrode. The substrate may be fabricated from silicon, $SiO_2$, fused silica, quartz, borosilicate glass, metals, dielectrics, or a combination thereof, for example.

An intercalable compound may be utilized for the second electrode and/or the atom reservoir. An "intercalable compound" (or "intercalatable compound") is a host material that is capable of forming an intercalation compound with guest atoms which comprise the atomic vapor in the vapor cell. Stated another way, the intercalable compound is intercalative for (capable of intercalating) at least some of the atoms in the atomic vapor. The guest atoms that are intercalated may be neutral atoms, ionic species, or a combination thereof. Typically, the guest atoms are intercalated as neutral atoms.

In some embodiments, the host material actually contains the guest species, resulting in a material which may be referred to as an "intercalation compound." It is noted that for the purposes of this patent application, any reference to intercalable compound may be replaced by intercalation compound, and vice-versa, since an intercalable compound must be capable of intercalating a guest species but may or may not actually contain the intercalated guest species.

"Intercalation" herein is not limited to the reversible inclusion or insertion of an atom, ion, or molecule sandwiched between layers present in a compound, which shall be referred to herein as "layer intercalation." Intercalation also includes absorption of neutral atoms or ionic species into a bulk phase of the compound, whether that phase is amorphous or crystalline; adsorption of neutral atoms or ionic species onto an outer surface or an internal surface (e.g., a phase boundary) present in the compound; and reversible chemical bonding between the neutral atoms or ionic species, and the compound.

In some embodiments, the intercalable compound is a carbonaceous material, such as a material selected from the group consisting of graphite, graphene, holey graphene, graphene platelets, carbon nanotubes, fullerenes, activated carbon, coke, pitch coke, petroleum coke, carbon black, amorphous carbon, glassy carbon, pyrolyzed carbon-containing molecules, pyrolyzed parylene, polyaromatic hydrocarbons, and combinations thereof.

The carbonaceous material may be at least 50 wt % carbon, preferably at least 75 wt % carbon, more preferably at least 90 wt % carbon, most preferably at least 95 wt % carbon. In some embodiments, the carbonaceous material is essentially pure carbon, except for impurities. The carbonaceous material may include mesoporous carbon, microporous carbon, nanoporous carbon, or a combination thereof.

The intercalable compound may be a form of predominately $sp^2$ bonded carbon. Examples of $sp^2$ bonded carbon include, but are not limited to, graphite, graphene, carbon nanotubes, carbon fibers, fullerenes (e.g. $C_{60}$ or $C_{70}$), pyrolyzed carbon-containing molecules or polymers (such as pyrolyzed parylene, e.g. parylene-N, parylene-C, or parylene-AF-4), and large polyaromatic hydrocarbons (e.g. pentacene, rubrene, hexabenzocoronene, or coronene). In the case of graphene (which is essentially a single layer of graphite), the graphene may be monolayer graphene or multiple layers of graphene. Graphene flakes (a few layers of graphene) may be utilized. Certain embodiments utilize monolayer holey graphene, multiple layers of holey graphene, or graphene platelets.

In certain embodiments, the carbonaceous material comprises graphite. Graphite consists of planes of carbon sheets. Alkali atoms readily intercalate between these carbon sheets, leading to a high diffusivity for alkali atoms. Graphite electrodes enable fast alkali transport at low voltages and low power consumption per atom removed. Graphite transports not only atoms via intercalation, but also electricity due to the electron delocalization within the carbon layers. Valence electrons in the carbon are free to move, thereby conducting electricity through the graphite.

The graphite may be natural graphite (e.g., mined graphite) or synthetic graphite produced from various techniques. For example, graphite may be obtained from chemical-vapor-deposited graphitic carbon, carbide-derived graphite, recycled graphite, waste from graphene manufacture, and so on. Crystalline flake graphite occurs as isolated, flat, plate-like particles with hexagonal edges if unbroken; when broken the edges can be irregular or angular. Amorphous graphite is very fine flake graphite. Lump graphite occurs in fissure veins or fractures and appears as massive platy intergrowths of fibrous or acicular crystalline aggregates. Highly oriented pyrolytic graphite is graphite with an angular spread between the graphite sheets of less than 1°.

The graphite may be crystalline, amorphous, or a combination thereof. The graphite crystallinity may range from about 10% to about 90%, for example. A mixture of crystalline and amorphous graphite may be beneficial for intercalation not only between crystal layers but also between crystalline and amorphous regions of the graphite. With too much crystallinity, the diffusivity becomes highly anisotropic. If highly crystalline (i.e. highly anisotropic) graphite is oriented with the low-diffusivity axis normal to the surface of the device (which is a typical orientation), reduced alkali flux, and thus reduced performance, would result.

Functionalized carbon, such as graphite oxide or graphene oxide, may be employed in the intercalable compound of the second electrode.

In other embodiments, the intercalable compound of the second electrode is a transition-metal oxide, a transition-metal dichalcogenide, or a combination thereof. The intercalable compound may also be a mixture of a carbonaceous material and a transition-metal oxide, or a mixture of a carbonaceous material and a transition-metal dichalcogenide, or a mixture of all of these materials. Specifically, the intercalable compound may be a metal dichalcogenide selected from $MoS_2$, $TaS_2$, $TiTe_2$, or any other transition metal dioxide, disulfide, diselenide, or ditelluride.

In some embodiments, the second electrode is fabricated from particles of an intercalable compound dispersed in a matrix. The matrix may be a polymer binder, such as polyvinylpyrrolidone, cellulose resin, fluoroelastomer, or polyacrylic. The polymer binder preferably has low outgassing potential and is compatible with ultra-high vacuum. Optionally, additives may be introduced into the matrix to increase the electrical conductivity of the second electrode. Such additives may be metals or small conductive carbon particles (e.g. Super-P® Conductive Carbon Black).

Some variations of the invention provide a method of electrochemically emitting ions from a field-emission ion source, the method comprising:

(i) providing a device comprising:

(a) an ion conductor comprising a protuberance within a protuberance region, wherein the ion conductor contains mobile ions;

(b) a first electrode disposed distally from, and not in contact with, the ion conductor, wherein the protuberance region is on the same side of the first electrode as the ion conductor;

(c) a second electrode in contact with the ion conductor, wherein the second electrode is electrically isolated from the first electrode;

(d) an electrical insulator forming one or more insulating walls of the protuberance region; and (e) an atom reservoir that is electrochemically configured to controllably supply or receive atoms;

(ii) applying an electrode potential between the first electrode and the second electrode, wherein second-electrode voltage is higher than first-electrode voltage;

(iii) oxidizing or reducing the atoms in the atom reservoir, and transporting the atoms into and through the ion conductor as mobile ions; and (iv) emitting the mobile ions from the protuberance.

Some variations provide a method for operating a device (field-emission ion source), including the following steps. A first step may include placing the device in a vacuum or in a rarefied gas. A voltage may be applied between the first and second electrodes. The applied voltage may be about, or at least about, 100 V, 200 V, 300 V, 400 V, 500 V, 600 V, 700 V, 800 V, 900 V, 1 kV, 1.5 kV, 2 kV, or higher.

When the ions to be emitted are cations (e.g., metal or semimetal ions), the electric potential is configured to be higher at the second electrode compared to the first electrode, thereby causing an electric driving force in the direction toward the first electrode. The polarity need to be opposite when the mobile ions are anions rather than cations. When the ions to be emitted are anions (e.g., nonmetal ions such as halogen ions), the electric potential is configured to be lower at the second electrode compared to the first electrode, thereby causing an electric driving force in the direction toward the first electrode.

In the case of cations (such as metal ions), under the applied voltage, atoms in the reservoir (near the second electrode) will be oxidized and transported, as cations, into the ion conductor. Cations will transport within the ion conductor, into a protuberance and toward the first electrode, in the direction of decreasing protuberance width. At least some of the cations will emit at or near the end of the protuberance (e.g., from a sharp tip), into the ambient field.

In the case of anions (such as halogen ions), under the applied voltage, atoms in the reservoir (near the second electrode) will be reduced and transported, as anions, into the ion conductor. Anions will transport within the ion conductor, into a protuberance and toward the first electrode, in the direction of decreasing protuberance width. At least some of the anions will emit at or near the end of the protuberance (e.g., from a sharp tip), into the ambient field.

Optionally, a heater is used to increase ion conductivity by increasing temperature, such as to about 50° C., 100° C., 200° C., 300° C., 400° C., or 500° C. A heater is configured to provide heating to a selected heated region, such as a region containing the first electrode, the second electrode, the ion conductor, and/or the protuberance region. The heater may be a resistive heater, such as a thin-film resistive heater, e.g. a patterned thin metal trace (e.g., platinum or nickel-chromium alloy). The heater may alternatively be a radiative heater, a thermoelectric heater, an inductive heater, another type of heater, or a combination of heaters.

The ion source may include a temperature sensor. At least one temperature sensor may be included for monitoring and controlling the temperature of the heated region. The temperature sensor may be a thermocouple, a resistance temperature detector (RTD), a semiconductor-based sensor, a thermistor, or another type of temperature sensor. In some embodiments, a Pt-based RTD is employed as the temperature sensor. In some embodiments, the temperature sensor is patterned on the same layer that contains (e.g., is patterned with) the heater.

Optionally, when the ion source is disposed in a gas, the pressure of the gas is varied to change the field-emission dynamics. The pressure of the gas may be varied, such as about, or less than about, 1 bar, 0.5 bar, 0.1 bar, 0.01 bar, 0.001 bar, 0.0001 bar, or less, including complete vacuum (0 bar). The gas may include air, $N_2$, $CH_4$, He, Ar, Ne, Xe, $NH_3$, or a combination thereof, for example.

The ion source may provide ions into a field that is hermetically sealed. The ion source may provide ions into a field that is in fluid communication with a larger system, which may or may not be collectively hermetically sealed. The larger system, for example, could be part of a high-vacuum system containing pumps, pressure/vacuum gauges, atom dispensers, getters, getter pumps, getter sources, pill sources, etc. The ion source may provide ions into a field that contains an object (e.g., a metal plate) to be milled or etched.

The rate of ion emission may vary widely. In the case of a single miniature tip protuberance, for example, the ion current may be from about 1 picoampere ($10^{-12}$ A) to about 10 milliamperes ($10^{-2}$ A). Arrays of protuberances are capable of emitting much higher ion currents, depending on size of array, overall device size, selection of materials, and so on. The actual number of ions emitted per second from a given device may be calculated from a known ion current per protuberance and specification of the overall device design.

The spatial pattern of ion field emission may vary, depending on a number of factors, potentially including applied voltage, temperature, pressure, protuberance minimum size (e.g., tip radius) and its ratio with the aperture size, type and quantity of ions, the ratio of mass of protuberances to total ion-conductor mass, and the average coaxiality of protuberances with apertures, for example. Quantum-mechanical effects (e.g., the wave nature of the ions) may or may not be important in dictating the observed ion field-emission patterns.

The ion source may be implemented at a wide variety of length scales. The length scale may be characterized by the cube root of the ion-source system volume. This length scale may vary widely. A length scale from about 30 mm to about 10 microns is typical for chip-scale atomic timing and navigation systems, with 0.5-10 mm being preferable.

The present invention is applicable to compact ion and atom clocks; accelerometers; and gyroscopes for position, navigation, and timing; ion-milling systems; ion-etching systems; and systems to build-up intricate metallic structures from metal ions, for example.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. An electrochemical solid-state field-emission ion source comprising:

(a) an ion conductor comprising a protuberance within a protuberance region, wherein said ion conductor contains mobile ions;

(b) a first electrode disposed distally from, and not in contact with, said ion conductor, wherein said protuberance region is on the same side of said first electrode as said ion conductor;

(c) a second electrode in contact with said ion conductor, wherein said second electrode is electrically isolated from said first electrode; and (d) an electrical insulator between said ion conductor and said first electrode.

2. The ion source of claim 1, wherein said first electrode is configured with an aperture, and wherein said aperture is an opening into a protuberance region containing said protuberance.

3. The ion source of claim 1, wherein said first electrode is in the form of an electrode plate proximally disposed, but not touching, said protuberance.

4. The ion source of claim 1, wherein at least a portion of said first electrode is in the form of an electrode protuberance proximally disposed, but not touching, said protuberance.

5. The ion source of claim 1, wherein said ion conductor comprises one or more additional protuberances.

6. The ion source of claim 5, wherein said ion conductor comprises at least four total protuberances that form a two-dimensional periodic array.

7. The ion source of claim 1, wherein said aperture is spatially aligned with said protuberance.

8. The ion source of claim 1, wherein said aperture has an aperture diameter or size that is less than a protuberance-region diameter or length scale.

9. The ion source of claim 1, wherein said protuberance has a minimum diameter or length scale less than 1 micron.

10. The ion source of claim 1, wherein said protuberance includes a sharp tip.

11. The ion source of claim 1, wherein said protuberance is a sharp blade.

12. The ion source of claim 11, wherein said sharp blade is curved.

13. The ion source of claim 1, wherein said ion conductor further comprises an ion-conducting layer interposed between said second electrode and said electrical insulator, and wherein said protuberance protrudes from said ion-conducting layer toward said first electrode.

14. The ion source of claim 13, wherein said ion-conducting layer and said protuberance are of the same composition.

15. The ion source of claim 13, wherein said electrical insulator is interposed between said first electrode and said ion-conducting layer.

16. The ion source of claim 1, wherein said electrical insulator forms one or more insulating walls of said protuberance region.

17. The ion source of claim 1, wherein said ion conductor is a solid electrolyte selected from the group consisting of β-alumina, β"-alumina, NASICON, alkali-ion-exchanged NASICON, LISICON, alkali-ion-exchanged LISICON, KSICON, alkali-ion-exchanged KSICON, chalcogenide glasses, and combinations thereof.

18. The ion source of claim 1, wherein said mobile ions are selected from metal ions, and wherein said metal ions are optionally selected from the group consisting of $Na^+$, $K^+$, $Rb^+$, $Cs^+$, $Sr^{2+}$, $Ca^{2+}$, $Yb^{3+}$, $Hg^{2+}$, and combinations thereof.

19. The ion source of claim 1, wherein said ion conductor has ionic conductivity of said mobile ions of at least $10^{-7}$ S/cm at 25° C.

20. The ion source of claim 1, said ion source further comprising an atom reservoir that is electrochemically configured to controllably supply or receive atoms.

21. The ion source of claim 20, wherein said atoms are the same elements as said mobile ions.

22. The ion source of claim 20, wherein said atom reservoir contains an intercalable compound.

23. A method of electrochemically emitting ions from a field-emission ion source, said method comprising:

(i) providing a device comprising:

(a) an ion conductor comprising a protuberance within a protuberance region, wherein said ion conductor contains mobile ions;

(b) a first electrode disposed distally from, and not in contact with, said ion conductor, wherein said protuberance region is on the same side of said first electrode as said ion conductor;

(c) a second electrode in contact with said ion conductor, wherein said second electrode is electrically isolated from said first electrode;

(d) an electrical insulator between said ion conductor and said first electrode; and (e) an atom reservoir that is electrochemically configured to controllably supply or receive atoms;

(ii) applying an electrode potential between said first electrode and said second electrode;

(iii) oxidizing or reducing said atoms in said atom reservoir, and transporting said atoms into and through said ion conductor as said mobile ions; and (iv) emitting said mobile ions from said protuberance.

24. The method of claim 23, wherein said device is disposed in a vacuum or rarefied gas.

25. The method of claim 23, wherein said electrode potential is at least 500 V.

* * * * *